US008911416B2

(12) United States Patent
Johnson

(10) Patent No.: US 8,911,416 B2
(45) Date of Patent: Dec. 16, 2014

(54) LINER FOR A BRA

(75) Inventor: Erin L. Johnson, Perrysburg, OH (US)

(73) Assignee: Principle Business Enterprises, Inc., Dunbridge, OH (US)

( * ) Notice: Subject to any disclaimer, the term of this patent is extended or adjusted under 35 U.S.C. 154(b) by 353 days.

(21) Appl. No.: 13/325,387

(22) Filed: Dec. 14, 2011

(65) Prior Publication Data

US 2012/0157951 A1 Jun. 21, 2012

Related U.S. Application Data

(60) Provisional application No. 61/459,622, filed on Dec. 15, 2010.

(51) Int. Cl.
*A61F 13/15* (2006.01)
*A41C 1/06* (2006.01)

(52) U.S. Cl.
USPC ..... 604/385.07; 604/385.03; 450/37

(58) Field of Classification Search
USPC ..... 604/385.07, 385.03
See application file for complete search history.

(56) References Cited

U.S. PATENT DOCUMENTS

| | | | | |
|---|---|---|---|---|
| 1,078,443 | A | 11/1913 | Just | |
| 2,258,277 | A | 10/1941 | Bullinger | |
| 2,505,720 | A | 4/1950 | Peiser et al. | |
| 3,164,155 | A | 1/1965 | Simonsen | |
| 3,402,719 | A | 9/1968 | Simonsen | |
| 3,419,895 | A | 12/1968 | Stephensen | |
| 3,642,009 | A | 2/1972 | Nobbs | |
| 3,890,978 | A | 6/1975 | Nobbs | |
| 4,747,162 | A | 5/1988 | Yanagihara | |
| 5,149,336 | A | 9/1992 | Clarke | |
| 5,269,720 | A | 12/1993 | Moretz | |
| 5,326,305 | A | 7/1994 | Fochler | |
| 5,385,502 | A | 1/1995 | Moretz | |
| 5,573,441 | A | 11/1996 | Smith | |
| 5,690,536 | A | 11/1997 | Madden | |
| 5,980,359 | A | 11/1999 | Brown | |
| 5,996,120 | A | 12/1999 | Balit | |
| 6,074,272 | A * | 6/2000 | Hebert | 450/37 |
| 6,203,399 | B1 | 3/2001 | Hackney | |
| 6,264,530 | B1 | 7/2001 | Cosentino | |
| 7,201,629 | B2 | 4/2007 | Lambru | |
| 7,585,200 | B1 | 9/2009 | McLaren | |
| 7,793,358 | B2 | 9/2010 | Frye | |
| 7,794,304 | B2 | 9/2010 | Frye | |
| 2009/0069766 | A1 | 3/2009 | Bannister | |
| 2010/0101585 | A1 | 4/2010 | Frye | |
| 2010/0101586 | A1 | 4/2010 | Frye | |
| 2010/0105286 | A1 | 4/2010 | Frye | |

* cited by examiner

*Primary Examiner* — Jacqueline F. Stephens
(74) *Attorney, Agent, or Firm* — Emch, Schaffer, Schaub & Porcello, Co., L.P.A.

(57) ABSTRACT

The liner has a first sheet of fluid pervious non-woven material having a first edge and a second edge. A second sheet of fluid pervious non-woven material having a first edge and a second edge is positioned in adjacent relationship to the first sheet. The first edge of the second sheet is joined to the first edge of the first sheet and the second edge of the second sheet is joined to the second edge of the first sheet. A breathable compartment is formed between the first and second sheets. A layer of super absorbent gel material and cotton fluff is positioned in the compartment. The absorbent gel material is disposed in the compartment to absorb fluids while the liner is breathable and comfortable for the user.

10 Claims, 2 Drawing Sheets

LINER FOR A BRA

CROSS REFERENCE TO RELATED APPLICATIONS

This application claims the benefit of U.S. provisional patent application No. 61/459,622 and filed on Dec. 15, 2010.

BACKGROUND OF THE INVENTION

The present invention is a highly absorbent bra liner product. The product is designed to be placed in a bra to reduce moisture and to control undesirable skin conditions in the breast area of a user.

Absorbent bras and liners have been used in the past to control moisture in the breast area of a user. These products have been usually pads that are inserted between the fabric layers of a bra or a separate liner that is positioned between the bra and the breasts of the user. These products did not satisfactorily control the moisture and frequently retained a moist pad adjacent to the breast. These prior devices also could still transfer the moisture to the clothing of the user. In addition, the structure of these prior devices were not completely breathable and frequently were not very comfortable for the user.

Accordingly, there is need for a bra liner that is fully breathable to keep the skin of the user as dry and comfortable as possible. The liner should absorb and retain the moisture in an absorbent material that removes the moisture from contact with the user and the users clothing. The liner should have a thin profile while having the ability to absorb and retain a significant amount of moisture. The liner should not be particularly noticeable when worn by the user. The liner should be soft and comfortable when being worn and the liner should stay in place.

SUMMARY OF THE INVENTION

The above needs for a bra liner are met by the product of the current invention. The liner has a first sheet of fluid pervious or hydrophilic 100% cotton non-woven material having a first edge and a second edge. A second sheet of fluid pervious non-woven material having a first edge and a second edge is positioned in adjacent relationship to the first sheet. The first edge of the second sheet is joined to the first edge of the first sheet and the second edge of the second sheet is joined to the second edge of the first sheet. A breathable compartment is formed between the first and second sheets. A layer of super absorbent gel material is positioned in the compartment. A layer of hydrophilic cotton fluff or airlaid fiber can be combined with the super absorbent gel layer. The absorbent gel material is disposed in the compartment to absorb fluids while the liner is breathable and comfortable for the user.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 1:
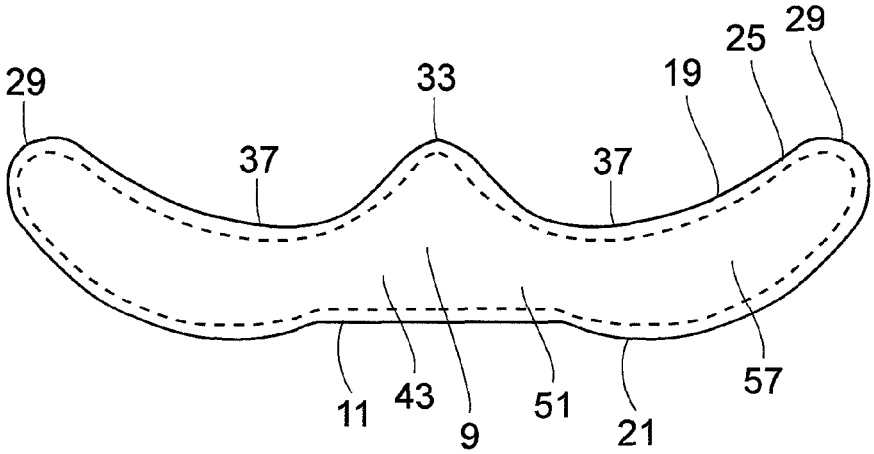
FIG. 1 is a front elevation view of the liner.
Figure 2:
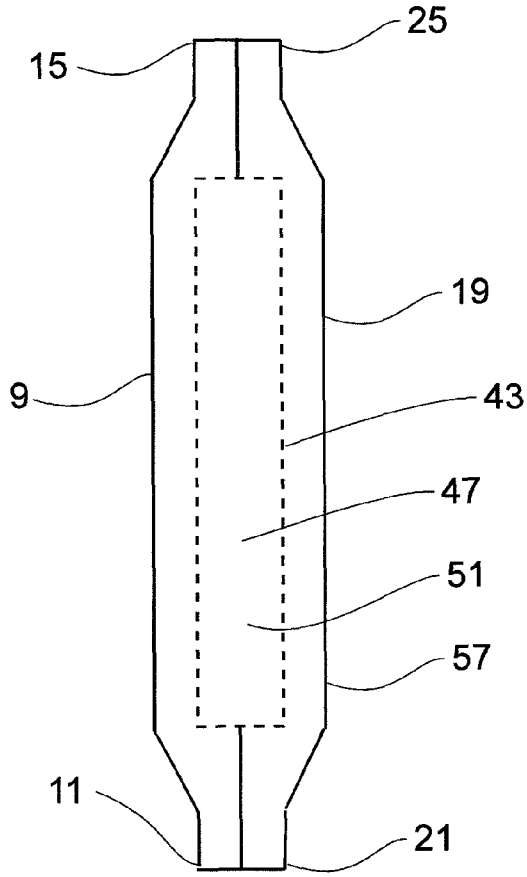
FIG. 2 is a cross sectional view taken along line 2-2 of FIG. 1.
Figure 3:
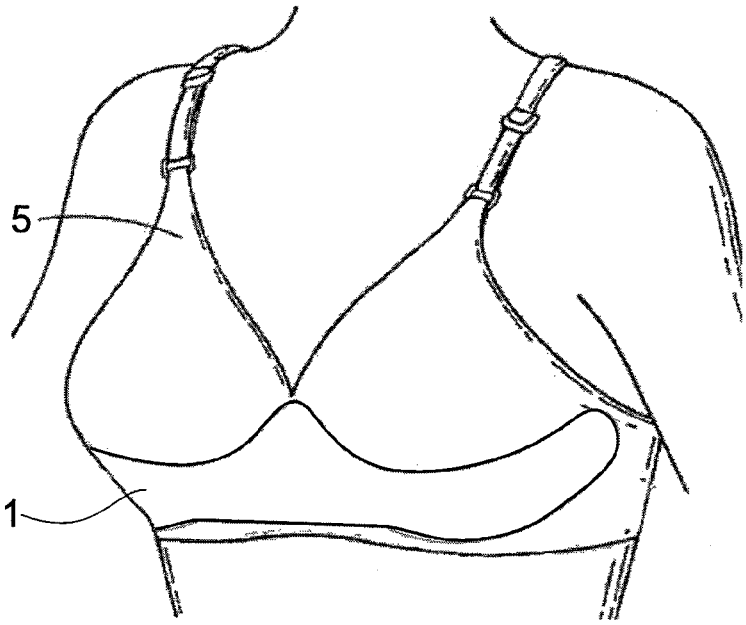
FIG. 3 is a perspective view of the liner in position in a bra.

The present invention is directed to a liner that can be used in the bra that supports the breast of a user. The liner is positioned in the bra to absorb moisture and to increase the comfort of the user of the liner. The liner can also function to reduce or eliminate rashes and other skin disorders that can occur when moisture is retained in this area on the body of the user. The features of the invention will be more fully understood by referring to the attached drawings in combination with following description.

The liner 1 is constructed for being positioned in the bra 5 that supports the breast of a user in a manner clearly well understood in the art. The liner is comprised of a first sheet of fluid pervious non-woven or hydrophilic 100% cotton material 9 having a first edge 11 and a second edge 15. A second sheet of fluid pervious non-woven or hydrophilic 100% cotton material 19 is positioned in opposed relationship with the first sheet 9. The second sheet has a first edge 21 and a second edge 25. The first edge 21 of the second sheet 19 is disposed to be joined to the first edge 11 of the first sheet 9. The second edge 25 of the second sheet 19 is disposed to be joined to the second edge 15 of the first sheet 9. The first edge of the first and second sheets is disposed to extend laterally across the torso of the user and to be generally in alignment with the bottom edge of the bra disposed beneath the breast of the user. The second edges of the first and second sheets have a contoured shape to allow the liner 1 to comfortably fit under the breast of the user. The second edges of the first and second sheet define a raised area 29 at each end of the liner and a raised section 33 in the center of the liner to position the liner around the breast of the user. A radiused portion 37 is located on the second edge of the first and second sheets between the raised areas on each end of the liner and raised section 33 in the center of the liner 1. Each end of the first edge 11, 21 of the first and second sheets 9, 19 have a curved portion 41 that connects to the raised areas 29 on each end of the first and second sheets. The curved portion has a radius of curvature that is similar to the radius of curvature for the radiused portion 37 on the second edge of the first and second sheets.

The first sheet 9 of the fluid pervious non-woven material is designed to be positioned against the body of the user. The second sheet 19 of the fluid pervious non-woven material is designed to be disposed against the bra that is used to support the breast of the user. The first and second edges of the first and second sheets are secured together to form a compartment 43 between the first and second sheets of the liner 1. The compartment 43 extends substantially along the entire length of the first and second sheets. A layer 47 of absorbent material is positioned in the compartment 43. The layer of absorbent material can be any type of absorbent material that is used in diapers or panty liner type of products to attract and retain moisture. In practice it has been found that super absorbent laminate composite gel material works particularly well for the absorbent layer 47. A super absorbent laminate composite material that works particularly well is Gelok® super absorbent that is sold by Gelok International Corporation. The Gelok super absorbent material has the additional advantage that it acts to neutralize odors. The super absorbent gel material can be combined with hydrophilic cotton fluff and/or airlaid fiber 51 to enhance the properties of the absorbent layer 47. The fluid pervious nature of the first sheet 11 and the second sheet 19 allows perspiration and other fluids in the area of the breast of the user to pass through to the compartment 43 and be absorbed in the absorbent layer 47. In this manner perspiration in the breast area of the user is attracted to and absorbed in the liner 1 thereby enhancing the comfort for the user of liner 1. The first sheet 9 and the second sheet 19 are constructed of fluid pervious non-woven materials that are characterized as being breathable. This allows air to flow through the first and second sheets to enhance the comfort level of the user of the liner 1. The breathable nature of the first and second sheets allows air to move through both sides of the liner to provide the highest level of breathability possible. As the fabric used to construct most bras is breathable there is no interruption of the breathability on the second sheet 19 of the liner 1 that faces the bra 5. This is an important factor in maximizing the comfort for the user of the liner 1.

The first and second edges of the first and second sheets can be joined together by various sealing mechanisms that are well known in the art. In particular, heat sealing and a thin layer of sprayed adhesive have been found to be particularly effective for securing together the first and second edges of the first and second sheets.

To enhance the performance of the liner 1 an antimicrobial and anti-fungal coating 57 can be provided on the first and second sheets of the non-woven material. Although it is preferable to have the coating 57 on both the first and second sheets it is possible to provide this coating only on the first sheet 9 that is in contact with the torso of the user. The coating 57 acts to reduce or eliminate microbial and fungal elements that can be present where the skin of the user is subjected to perspiration or other fluids. The coating 57 functions to further reduce the likelihood of rashes or other skin disorders developing in the breast area of the user.

In use the liner 1 is positioned in the bra 5 with the first edge of the first and second sheets positioned adjacent the lower edge of the bra 5. The raised area 29 on each end of the liner 1 are disposed to be adjacent the outer edge of the breast of the user. The raised section 33 in the center of the liner 1 is disposed to be positioned between the breast of the user and generally in the center of the bra 5. The radiused portions 37 on each side of the liner 1 are disposed to be positioned beneath the breast of the user. When the liner 1 is positioned in the bra 5, the bra can be positioned on the user and used in the normal manner. Perspiration and other fluids that can develop in the area of the breast can pass through the first sheet 9 and the second sheet 19 of non-woven material and are absorbed in the layer 47 of absorbent material. The absorbent material is designed to retain the perspiration or other fluids so that the liner 1 feels dry to the user. The breathable nature of the first sheet 9 and the second sheet 19 allow air to pass through the liner 1 to enhance the comfort of the user of the liner 1. The super absorbent material that is preferred for the layer 47 is capable of absorbing a considerable quantity of fluid to keep the user as comfortable as possible when the user is exercising or subjected to hot and humid conditions that generate perspiration in this area of the body of the user. The liner 1 functions to absorb such perspiration or other fluids so that the bra and clothing of the user do not become wet or discolored from the perspiration or other fluids. The liner 1 functions to protect and extend the useable life of the bra and other clothing worn by the user in conditions where perspiration in the breast area of the user is likely to develop. The liner 1 is designed so that the absorbent layer 47 can normally be used for several days before the absorbing characteristics of the layer 47 are exhausted. In practice it has been found that the liner 1 can used from about 3 to about 20 days before the absorbing characteristics of the liner are exhausted. Once the absorbing characteristics of the liner are used up the liner is disposed of and a new liner can be utilized.

The antimicrobial and antifungal coating 57 further enhance the comfort factor of the user of the liner 1. This coating 57 can also function to reduce odors in the liner 1 caused by the perspiration from the user. Thus, the coating 57 can function to extend the useable life of the liner 1.

Figure 4:
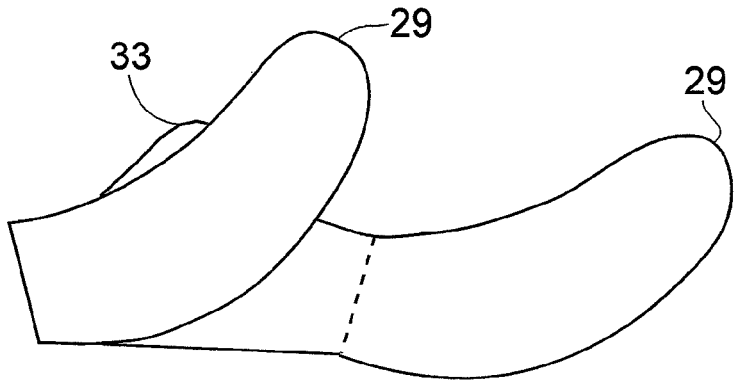
FIG. 4 is a front view of the liner in a partial folded position.
Figure 5:
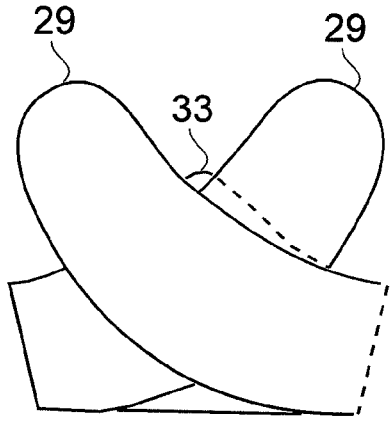
FIG. 5 is a front view of the liner in a fully folded position.

One of the limiting factors in the use of such a liner is packaging the liner in a manner where it can be easily stored until it is time to use the liner. As shown in FIGS. 4 and 5 the liner 1 of the current invention is designed so that the raised area 29 on each end of the liner 1 can be folded across the raised section 33 in the center of the liner to form a very attractive package for the liner. The first edge of the first and second sheets remains in the same plane when the liner is folded and the fold is made in the radiused portion 37 on each side of the liner 1. The raised area 29 on each side of the liner 1 is positioned so that it overlaps the raised section 33 in the center of the liner. Fold lines 61 can be positioned on the liner 1 to assist in properly folding the liner. In other words the raised area on one end of the liner 1 is positioned on the opposite side of the raised section 33 in the center of the liner after the folding operation takes place. The liner 1 that is folded in this manner has a relatively small profile that allows the liner to be easily packaged. In addition, this folded configuration for the liner has a pleasing appearance that further enhances the usability of the liner 1.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A liner for positioning in a bra that supports the breasts of a user comprising:

a first sheet of fluid pervious non-woven material having a first edge and a second edge;

a second sheet of fluid pervious non-woven material having a first edge and a second edge, the first edge of the second sheet joined to the first edge of first sheet and the second edge of the second sheet joined to the second edge of the first sheet;

a breathable compartment being formed between the first and second sheet; the compartment extending substantially along the entire length of the first and second sheets;

a layer of super absorbent gel material positioned in the compartment, the absorbent gel material is disposed in the compartment to absorb fluids while being breathable to be comfortable for the user;

the first edge of the first and second sheets being disposed to extend latterly across the torso and to fit under the breasts of the user and to be generally in alignment with a bottom edge of the bra; and the second edge of the first and second sheet have a contoured shape to fit under the breasts of the user.

2. The liner of claim 1 wherein an antimicrobial and antifungal coating is provided on the first and second sheets of non-woven material.

3. The liner of claim 1 wherein the first and second edges of the first and second sheets are joined by heat sealing.

4. The liner of claim 1 wherein the first sheet of non-woven material is disposed to be positioned against the user and the second sheet is disposed to be positioned against the bra.

5. The liner of claim 1 wherein cotton fluff or airlaid fiber is combined with the super absorbent gel, the cotton fluff and airlaid fiber acting to assist in wicking moisture to the super absorbent gel.

6. The liner of claim 1 wherein the first and second edges of the first and second sheet are joined by an adhesive layer.

7. A liner for positioning in a bra that supports the breasts of a user comprising:

a first sheet of fluid pervious non-woven material having a first edge and a second edge;

a second sheet of fluid pervious non-woven material having a first edge and a second edge, the first edge of the second sheet joined to the first edge of first sheet and the second edge of the second sheet joined to the second edge of the first sheet;

a breathable compartment being formed between the first and second sheet;

a layer of super absorbent gel material positioned in the compartment, the absorbent gel material is disposed in the compartment to absorb fluids while being breathable to be comfortable for the user;

the second edge of the first and second sheets having a contoured shape to fit under the breast of the user, the second edge defining a raised area at each end and a raised section in the center to position the liner around the breast of the user, the raised area on each end of the liner being folded across the raised section in the center to provide or space saving and attractive packaging for the liner, a fold line being positioned between the raised section and the raised area on each side of the liner, the fold lines providing a defined folding location for the raised area;

a fold line is positioned between the raised section and the raised area on each side of the liner, the fold lines providing a defined folding location for the raised areas.

8. The liner of claim 7 wherein the fold lines are configured to have the raised areas on each side of the liner fold in the same direction towards the raised section.

9. The liner of claim 8 wherein the fold lines are disposed at an angle.

10. The liner of claim 9 wherein an angle from about 5° to about 30° is formed between the fold lines.

* * * * *